US007573203B2

(12) United States Patent
Kashiwagi et al.

(10) Patent No.: US 7,573,203 B2
(45) Date of Patent: Aug. 11, 2009

(54) MERCURY-FREE HIGH-PRESSURE DISCHARGE LAMP AND LUMINAIRE USING THE SAME

(75) Inventors: Takahito Kashiwagi, Kanagawa-ken (JP); Masazumi Ishida, Kanagawa-ken (JP); Mikio Matsuda, Tokyo (JP); Kozo Uemura, Kanagawa-ken (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 324 days.

(21) Appl. No.: 11/557,277

(22) Filed: Nov. 7, 2006

(65) Prior Publication Data

US 2007/0138964 A1 Jun. 21, 2007

(30) Foreign Application Priority Data

Nov. 7, 2005 (JP) ..... P2005-322748

(51) Int. Cl.
*H01J 17/20* (2006.01)
*H01J 61/12* (2006.01)

(52) U.S. Cl. ..... 313/637; 313/484; 313/567; 313/638; 313/643

(58) Field of Classification Search ..... 313/484, 313/567, 637, 638, 643
See application file for complete search history.

(56) References Cited

U.S. PATENT DOCUMENTS 6,353,289 B1 * 3/2002 Ishigami et al. ..... 313/637
2006/0255741 A1 * 11/2006 Ishigami et al. ..... 313/637
2007/0085482 A1 * 4/2007 Lambrechts et al. ..... 313/637

FOREIGN PATENT DOCUMENTS

JP 55032338 A * 3/1980

* cited by examiner

*Primary Examiner*—Toan Ton
*Assistant Examiner*—Kevin Quarterman
(74) *Attorney, Agent, or Firm*—DLA Piper LLP (US)

(57) ABSTRACT

A mercury-free high-pressure discharge lamp includes a light-transmissive airtight envelope enclosing therein a discharge space, and a pair of electrodes sealed inside the light-transmissive airtight envelope and facing the discharge space, and the primary halide includes at least thulium bromide having an innumerable emission spectrum primarily around the peak of a luminosity curve and alkali metal halide, and the accessory halide contains one or more metal halides mostly selected from a group of Magnesium (Mg), Iron (Fe), Cobalt (Co), Chromium (Cr), Zinc (Zn), Nickel (Ni), Manganese (Mn), Aluminum (Al), Antimony (Sb), Bismuth (Bi), Beryllium (Be), Rhenium (Re), Gallium (Ga), Titanium (Ti), Zirconium (Zr), and Hafnium (Hf) which primarily contribute to fix lamp voltage.

3 Claims, 4 Drawing Sheets

MERCURY-FREE HIGH-PRESSURE DISCHARGE LAMP AND LUMINAIRE USING THE SAME

CROSS REFERENCE TO RELATED APPLICATIONS

This application is based upon and claims the benefit of priority from the prior Japanese Patent Application JP2005-322748 filed on Nov. 7, 2005, the entire content of which is incorporated herein by reference.

FIELD OF THE INVENTION

Present invention relates to a high-pressure discharge lamp which is substantially excluding mercury therefrom and luminaire using the mercury-free high-pressure discharge lamp.

BACKGROUND OF THE INVENTION

A high-pressure discharge lamp, for example, a metal halide lamp, which substantially excludes mercury therefrom, is disclosed in Japanese laid-open patent JP11-238488A (hereinafter referred to as prior art I) etc. In the metal halide lamp disclosed in the prior art I, it is filled with two types of metal halides, i.e., a primary metal halide having relatively high vapor pressure and capable of mainly emitting light in visible range and an accessory halide hardly emitting light in the visible range in compared to the primary metal halide but contributing to fix lamp voltage, in place of mercury.

In the prior art I, as a first practical example, a metal halide lamp for liquid crystal projectors designed to have 4 mm inter-electrode distance and to operate at 150 W input power is described. In this first practical example, iodination dysprosium ($DyI_3$) by 1 mg and iodination neodymium ($NdI_3$) also by 1 mg are filled as a principal metal halide, respectively, and Argon (Ar) by 500 Torr is filled as rare gas. In this first practical example, when zinc iodide ($ZnI_2$) by 8 mg is filled as an accessory halide, lamp voltage is 73V, luminosity is 68 lm/W, and color temperature is 9160K.

Further, in the prior art I, as an eighth practical example, a metal halide lamp designed to have 30 mm inter-electrode distance and to operate at 2 KW input power is described. In this first practical example, 4 mg dysprosium bromide ($DyBr_3$), 4 mg holmium bromide ($HoBr_3$), and 4 mg thulium bromide ($TmBr_3$) are filled as the principal metal halide, respectively, and 100 Torr Argon (Ar) is filled as rare gas. In this eighth practical example, when 30 mg zinc iodide ($ZnI_2$) is filled as the accessory halide, lamp voltage is 112V, luminosity is 92 lm/W, color temperature is 5340K, and a average color rendition evaluation account is Ra73.

On the other hand, a high-pressure discharge lamp improved luminosity, light color, and life duration, but containing mercury as buffer gas is disclosed in Japanese laid-open patent JP2004-349242A (hereinafter referred to as prior art II). By carrying out the mass percentage of the sodium halide, the thallium halide, the indium halide, and the thulium halide into a prescribed range, respectively The metal halide lamp disclosed in the prior art I has acquired decent electrical property and luminescent property close to those of the conventional metal halide lamp using mercury, without using mercury of high environmental burden. However, an appearance of mercury-free metal halide lamp having luminosity sufficiently higher than conventional metal halide lamp is expected.

It is known to use Sodium (Na) as substance for emitting white light high-efficiently together with, for example, Scandium (Sc) and a rare earth metal. However, the D line of Sodium (Na) is an emission spectrum of 589 nm wavelength, and is separated from 555 nm, which is separated from 555 nm, i.e., peak of luminosity curve. Therefore, it is impossible to acquire sufficiently high luminosity with only Sodium (Na). So, in order to further advance efficiency, it is necessary to raise a temperature of the coldest part.

However, since there are various restrictions, such as the heat-resisting property of airtight envelope, the reactivity of Sodium (Na), etc. which constitute an arc tube, it is difficult to dramatically improve luminosity. In addition, in a mercury-free high-pressure discharge lamp, although Sodium contributes to improve luminosity, Sodium (Na) has a, fault which makes the inter-electrode potential gradient gentle, and results in reduction of lamp voltage. In order to supply a desired lamp electric power, it is necessary to make lamp current increase, since lamp voltage comes down in the case of that a discharge medium includes large quantity of Sodium, as mentioned above. For making lamp current increase, it is necessary to thicken the diameter of rod electrode. However, if a rod electrode is made thick, not only the design of the electrode itself and an airtight envelope becomes difficult, but also the design of stabilizer will also become difficult.

By the way, although the metal halide lamp of the prior art I is able to achieve electrical property and luminosity almost equivalent to those of conventional metal halide lamp using mercury, it is inferior in luminescence efficiency to the metal halide lamp using mercury.

On the other hand, in the mercury-free discharge lamp of the prior art II, since it is premised on using mercury as buffer gas, such a favorable luminosity as described are not obtained.

In a mercury-free high-pressure discharge lamp, thulium halide is suitable for emission medium. This is because that Thulium has an innumerable emission spectrum around the peak of luminosity curve, and that proper amounts of emission spectrum exist in short wavelength range from the peak of luminosity curve. However, the melting point of the iodination thulium often used in a mercury-free high-pressure discharge lamp is as high as 1030 degrees C. Therefore, in order to ionize Thulium and make it produce luminescence, it is necessary to raise arc tube temperature in matching with the above-mentioned melting point of iodination thulium.

However, if arc tube temperature is raised as mentioned above, the life of a mercury-free high-pressure discharge lamp will become shortened. Further, although iodination thulium can be pelletized by mixing with other halide substances, the iodination thulium fails to be pelletized alone, and only turns out powder. Therefore, it is difficult to include required amount of iodination thulium in the light-transmissive airtight envelope of a mercury-free high-pressure discharge lamp An object of the present invention is to provide mercury-free high-pressure discharge lamp in easy to manufacture, excellent in life property, luminosity and electrical property and luminaire using this mercury-free high-pressure discharge lamp.

SUMMARY OF THE INVENTION

A mercury-free high-pressure discharge lamp according to one aspect of the present invention is characterized by containing a light-transmissive airtight envelope enclosing therein a discharge space, and a pair of electrodes sealed inside the light-transmissive airtight envelope and facing the discharge space, and the primary halide includes at least thulium bromide having an innumerable emission spectrum primarily around the peak of a luminousity curve and alkali metal halide, and the accessory halide contains one or more metal halides mostly selected from a group of Magnesium (Mg), Iron (Fe), Cobalt (Co), Chromium (Cr), Zinc (Zn), Nickel (Ni), Manganese (Mn), Aluminum (Al), Antimony (Sb), Bismuth (Bi), Beryllium (Be), Rhenium (Re), Gallium (Ga), Titanium (Ti), Zirconium (Zr), and Hafnium (Hf) which primarily contribute to fix lamp voltage.

<Description of Principal Halide>

The primary halide is a metal halide which has an innumerable emission spectrum principally around the peak of a luminosity curve. In the present invention, the primary halide includes at least thulium bromide and alkali metal halides. By including thulium bromide, the mercury-free high-pressure discharge lamp according to the present invention exerts an exceptional operation and an effect, as described below.

Since Thulium has an innumerable emission spectrum near the peak of luminosity curve, and proper amounts of spectrum agreeing with the peak of luminosity curve in short wavelength range. It can be said that the thulium halide is an emission medium very effective for raising luminosity of a mercury-free high-pressure discharge lamp.

The inventors have found out that thulium bromide does not have such problems accompanied by the conventional mercury-free high-pressure discharge lamp. That is, thulium bromide has a relatively low melting point of 952 degrees C. Further, thulium bromide can be pelletized alone. Thulium bromide can be pelletized alone or combined with iodination thulium. Therefore, manufacture of a mercury-free high-pressure discharge lamp becomes easy. An optimal mixing ratio of thulium bromide and iodination thulium is more than 20 mass % to the whole of halides. When the amount of the thulium bromide 20 mass %, pelletizing will become difficult.

Further, the melting point of the thulium bromide is 952 degrees C. as mentioned above, and it is definitely lower than the melting point 1030 degrees C. of iodination thulium. Since even in such low melting point a vapor pressure will rise higher, it is able to utilize the emission spectrum of Thulium more effective than iodination thulium alone. Further, since it is able to lower the temperature of the light-transmissive airtight envelope constituting an arc tube. The life property of the mercury-free high-pressure discharge lamp is also improved.

Since alkali metal halide, for example, sodium halide is enclosed; it is able to improve much further luminosity, chromaticity, and/or color temperature. Further, since a curve of discharge arc in lighting operation is depressed alkali halide metal, the white roiling phenomenon of a light-transmissive airtight envelope is reduced. As for alkali halide metal, it is preferred that its amount is less than 10 mass % to whole of halides in the airtight envelope. Since lamp voltage tends to fall if the amount of alkali metal halide exceeds 10 mass %. It is not desirable from a standpoint of setting lamp voltage. However, if the amount of alkali metal halide is less than 10 mass %, lowering of lamp voltage will be depressed and kept to the minimum. While luminosity, lamp life, light color, especially color deviation can be improved. From the standpoints as mentioned above, it is admitted to use alkali metal halide under the condition to secure required lamp voltage. Here, the amount of an alkali metal halide is desirable to be two to eight mass %, more desirable to be three to seven mass %, and still further desirable to be four to six mass %. Further, Sodium (Na) is primarily used for alkali metal halide. However, at least either one of Cesium (Cs) or Lithium (Li) can be used at request. Sodium (Na) contributes primarily to luminosity improvement. Cesium (Cs) contributes to improvement of the life property by rationalizing discharge arc temperature. Lithium (Li) contributes to improvement of red color rendering properties.

<Description of Accessory Halide>

Accessory halide is a halide primarily contributing to fixation of lamp voltage. A mercury-free high-pressure discharge lamp according to the present invention is characterized by that; the accessory halide contains one or more metal halides primarily selected from a group of Magnesium (Mg), Iron (Fe), Cobalt (Co), Chromium (Cr), Zinc (Zn), Nickel (Ni), Manganese (Mn), Aluminum (Al), Antimony (Sb), Bismuth (Bi), Beryllium (Be), Rhenium (Re), Gallium (Ga), Titanium (Ti), Zirconium (Zr), and Hafnium (Hf).

<Other Aspect of Invention>

1. An ionization medium contains primary halide including thulium bromide having an innumerable emission spectrum primarily around the peak of a luminosity curve and accessory halide. When the mass percentage of thulium (Tm) halide to whole halide is labeled A, and the mass percentage of the accessory halide is labeled B, the mass percentages A and B satisfy following relations.

$$30<A<90$$

$$0<B<20$$

The above aspect of invention specifies first desirable ranges of the mass percentage A of the thulium halide to the whole of halides and the mass percentage B of the accessory halide to the whole of halides.

In a case of the mass percentage A of the thulium halide to the whole of halides being less than 30 percent, it is undesirable since luminosity is remarkably low. On the other hand, when the mass percentage A of the thulium halide to the whole of halides exceeds 90%, it is also undesirable since the amounts of halides other than the thulium halide is two little and results to cause failures such as white roiling.

Such a state that the mass percentage B of the accessory halide is less than 20 means that the amount of the accessory halide is relatively small. Since these result to failure of utilizing lamp voltage fixing operation of the accessory halide in place of mercury, potential gradient becomes small, and then lamp voltage becomes remarkably low. On the other hand, in a case of the mass percentage B of the accessory halide to the whole of halides being less than 20 percent, it is undesirable since luminosity is remarkably low.

According to the first aspect of the present invention, since the suitable range of mass percentage B of the accessory halide to the whole of halides is relatively narrow, a mercury-free high-pressure discharge lamp excellent in luminosity can be obtained.

Further, other than thulium halide the primary halide can be limited to specific halide of metal with ionization potential higher than 5.4 eV at request. Typical metals which can be utilized as halide for mercury-free high-pressure discharge lamp, wherein ionization potential is presented in parenthesis, are as follows.

(1) Primary halide: Thulium (6.18 eV); Praseodymium (5.42 eV); Cerium (5.47 eV); Samarium (5.63 eV); Indium (5.786 eV); Titanium (6.108 eV).

(2) Accessory halide: Aluminum (5.986 eV); Zinc (9.394 eV); Magnesium (7.644); Iron (7.87 eV); Cobalt (7.864 eV); Chromium (6.765 eV); Nickel (7.635 eV); Manganese (7.432 eV); Antimony (8.642 eV); Bismuth (7.287 eV); Rhenium (9.323 eV); Gallium (5.999); Titanium (6.84 eV); Zirconium (6.837 eV); Hafnium (7 eV).

On the other hand, alkali metals such as Sodium (5.14 eV); Lithium (5.392 eV), are of metal having ionization potential less than 5.40 eV. Therefore, when the amount of sodium halide or lithium halide increases, the lamp voltage lowers. Therefore, in this aspect of the invention, it is preferred that alkali metal halide is lessened or excluded substantially. Thereby, lowering of inter-electrode potential gradient in mercury-free high-pressure discharge lamp can be avoided.

2. An ionization medium contains primary halide including thulium bromide which is halide of the thulium having which has an innumerable emission spectrum principally around the peak of luminosity curve as a specification giving the highest priority to high potential gradient to utilizing short-arc type mercury-free high-pressure discharge lamp for projector (the specification admit lowering of efficiency) and the above mentioned accessory halide. When the mass percentage of Thulium (Tm) halide to whole halide is labeled A, and the mass percentage of the accessory halide is labeled B, the mass percentages A and B satisfy following relations.

$$50<A+B<95$$

$$20<=B<90$$

The above relations provide second desirable ranges of the mass percentage A of the thulium halide to the whole of halides and the mass percentage B of the accessory halide to the whole of halides. In this aspect of the present invention, the mass percentage A of the thulium halide is obtained to satisfy a relation of 5<A<7 by obtaining from the above two relations. However, it is preferable that the mass percentage A satisfies a relation of 30<A<75. Although the reason that the above range is preferable is the same as the reason in the first aspect of the invention, the upper limit of the range is relatively lowered, in contrarily proportion to that the mass percentage B is relatively high.

What is said that the sum "A+B" of the mass percentage A of the thulium halide and the mass percentage B of the accessory halide satisfies the relation; 50<A+B<95 means that it is available to add metal halide other than thulium halide to the primary halide. In such metal halide, there are, for example, thallium halide and alkali halide metal.

What is said that the mass percentage B of the accessory halide to the whole of halides satisfies the relation; 20<=B<90 means that the mass percentage of the accessory halide is relatively high. However, when the mass percentage B of the accessory halide is less than 20, it is unable to make the inter-electrode potential gradient steep and to raise lamp voltage of mercury-free high-pressure discharge lamp up to a voltage required in a short-arc type lamp. Further, when mass percentage B of the accessory halide exceeds 90 percent, luminosity remarkably comes down.

With that, in the second aspect of the invention, as the inter-electrode potential gradient is relatively large, in other word, lamp voltage is relatively high by that the mass percentage of the accessory halide is relatively high, it is able to achieve a mercury-free high-pressure discharge lamp excellent in the electrical property. Therefore, it is able to a short-arc type mercury-free high-pressure discharge lamp suitable for practical use.

3. When mass percentage of thulium bromide ($TmBr_3$) to the whole of halides is labeled C, the mass percentage C satisfies following relation;

$$5<C<60$$

This aspect of the present invention specifies a suitable range of the mass percentage of the thulium bromide. This aspect of the present invention is applicable to either of the first and second aspects of the present invention.

When the mass percentage C of the thulium bromide is less than 5, effects of luminosity improvement is no longer acquired fully. Further, when the mass percentage C of the thulium bromide exceeds 60, electrode dissipation advances rapidly, and then life property of mercury-free high-pressure discharge lamp is deteriorated. Here, the first or second aspect of invention can be added at request.

Then, according to the third aspect of invention, the aforementioned effects of the present invention can be fully acquired by using the thulium bromide.

4. As for an ionization medium, metal halide having ionization potential of 5.4 eV or more can be added to the primary halide. Here, this fourth aspect of invention can be added to either of the first to third aspect of invention at request.

According to the fourth aspect of invention, since it is easy to avoid fall of potential gradient, it is also easy to secure lamp voltage equivalent to the high-pressure discharge lamp employing mercury. Therefore, it is able to achieve mercury-free high-pressure discharge lamp which is easy to design electrode and ballast circuit, i.e., lighting circuit.

Luminaire according to the present invention is characterized by comprising luminaire main body, a mercury-free high-pressure discharge lamp as defined in any one of aspects as mentioned above, and a lighting circuit for lighting the mercury-free high pressure discharge lamp.

In this application, luminaire is of broad concept including every device employing high-pressure discharge lamp as light source. Therefore, the luminaire includes lighting fixtures as a matter of course, display devices, chemical reaction luminance apparatus, etc.

The luminaire main-body means remaining portion removed the high-pressure discharge lamp and the lighting circuit therefrom.

DESCRIPTION OF THE PREFERRED EMBODIMENTS

Referring now to the attached drawings FIGS. 1 to 3, a preferred embodiment of the mercury-free high-pressure discharge lamp according to the present invention will be described in detail.

Figure 1:
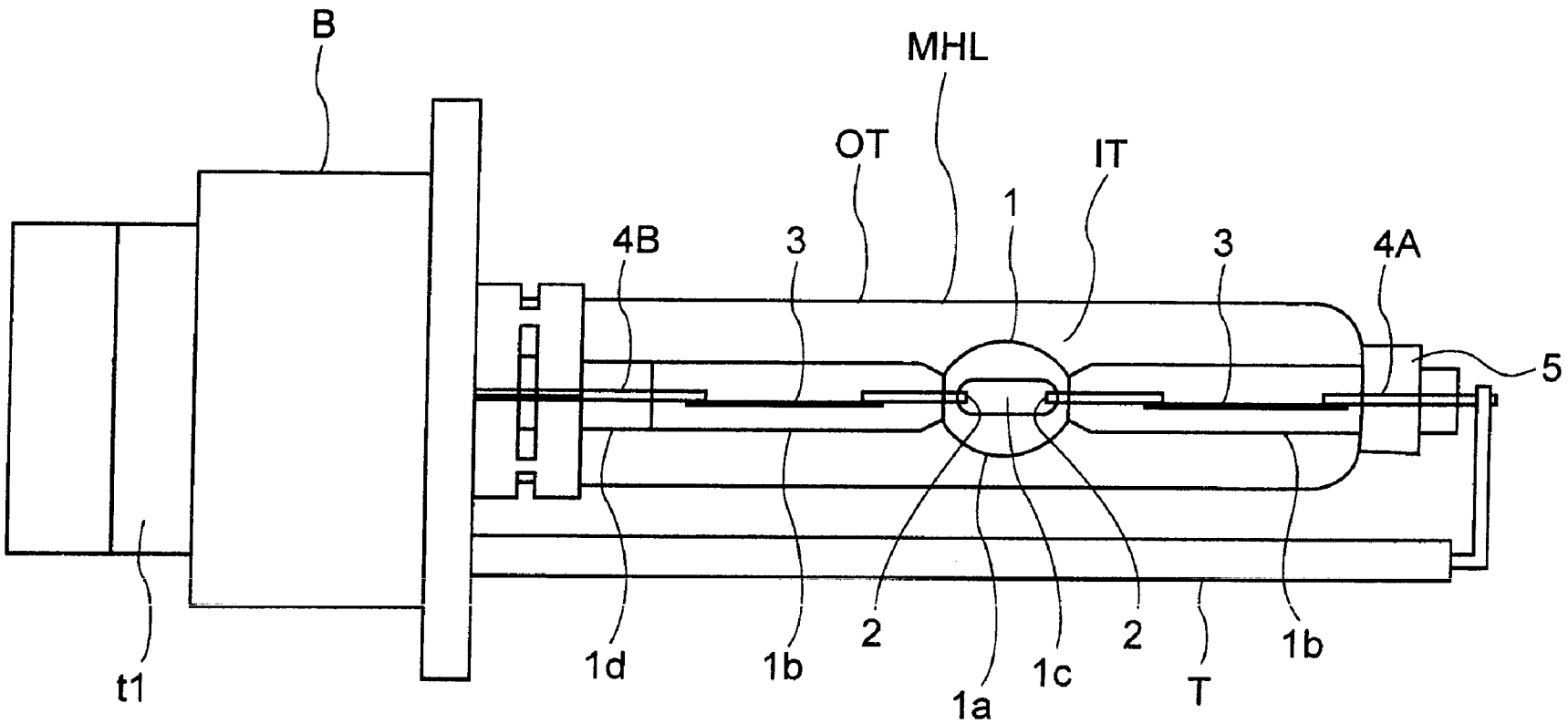
FIG. 1 is a front view showing one example of the mercury-free high-pressure discharge lamp according to the present invention.

FIG. 1 is a front view showing one embodiment of a mercury-free high-pressure discharge lamp according to one aspect of the present invention. This embodiment is a mercury-free high-pressure discharge lamp applied to an automobile headlight. In FIG. 1, the mercury-free high-pressure discharge lamp MHL is comprised of arc tube IT, insulation tube T, outer bulb OT, and bulb base B. Here, the mercury-free high-pressure discharge lamp MHL is equipped to automobile headlight in horizontal posture.

Arc tube IT is comprised of a light-transmissive airtight envelope 1, a pair of electrodes 2, 2, a pair of metal foils 3, 3, a pair of lead wires 4A, 4B and ionization medium filled in the light-transmissive airtight envelope 1.

As long as the material of the light-transmissive airtight envelope 1 has a heat-resisting property capable of bearing enough the usual operating temperature of the mercury-free high-pressure discharge lamp MHL and penetrates desired band visible light generated by discharge, the light-transmissive airtight envelope 1 may be made from any material. For example, quartz glass, light-transmissive ceramics, etc. can be used for the light-transmissive airtight envelope 1. As for the ceramics, poly-crystal body or mono-crystal body of alumina, YAG (Yttrium Aluminum Garnet), yttrium oxide (YOX), or aluminum nitride (AlN) can be used. The light-transmissive airtight envelope 1 may be coated a light-transmissive film on its inner surface, or the inner surface may be modified, as needed.

The light-transmissive airtight envelope 1 has discharge space 1*c* inside thereof and envelope 1*a* in the discharge space 1*c*. Enclosure 1*a* defines the discharge space 1*c* into proper shape, for example, ball-shape, ellipsoidal-shape, subcolumnar-shape. The volume of discharge space 1*c* may be defined in accordance with the rated lamp wattage, inter electrode distance, etc. of the mercury-free high-pressure discharge lamp MHL. For example, in the first embodiment applied to the headlamp of automobile, the volume of discharge space 1*c* is generally 0.1 cc or less. Meanwhile, when applied to the lamp for LCD projectors, the volume of discharge space 1*c* is generally 0.5 cc or less. In addition, when applied to the lamp for general lighting, the volume of discharge space 1*c* is set to 1 cc or more, or set to less than 1 cc, i.e., set widely.

In addition, a pair of sealing portions 1*b* and 1*b* is formed on both ends of the envelope 1*a*. Sealing portions 1*b*, 1*b* seal envelope 1*a*, and the shafts of electrodes 2, 2 are supported by the Sealing portions 1*b*, 1*b* as described later. Electrodes 2, 2 are supported by sealed portions 1*b*, 1*b* in airtight, and supplied electricity from lighting circuit (not shown).

In the case that the material of light-transmissive airtight envelope 1, by extension, sealing portions 1*b*, 1*b* is quartz glass, sealing portions 1*b*, 1*b* are entirely filled with quartz glass and bury therein metal foils 3, 3 in airtight. One ends of electrodes 2, 2 is welded to the ends of the metal foils 3, 3 on the side of discharge space 1*c*, while other ends of the electrodes 2, 2 are welded to lead wires 4, 4. Metal foils 3, 3 are buried in the sealing portions 1*b*, 1*b* in airtight, and feed currents supplied from lighting circuit to the electrodes 2, 2 in cooperation with lead wires 4A, 4B. As for material of the metal foils 3, 3, Molybdenum (Mo) is optimum, in the case that the light-transmissive airtight envelope 1 is made of quartz glass. Although a way of burying the metal foils 3, 3 in the sealing portions 1*b*, 1*b* is not specifically limited, it may be employed by selecting appropriate one from evacuation sealing method, pinch sealing method, etc.

Here, in the sealing portion 1*b* on the side of bulb base B, sealing pipe 1*d* extends to interior of the bulb base B in integral with the sealed portion 1*b*, without being cut out.

On the other hand, as for burying metal foils 3, 3 into sealing portions 1*b*, 1*b* in the case of that the light-transmissive airtight envelope 1, by extension, sealing portions 1*b*, 1*b* are made of ceramics, for example, frit sealing method of sealing by pouring frit into a gap between ceramics as the sealing portions 1*b*, 1*b* and metal foils 3, 3, or a way of laying ceramics piece homogeneous to the light-transmissive airtight envelope 1, by extension, sealing portions 1*b*, 1*b* or piece homogeneous to lead wires 4A, 4B and then fusing the piece thereto.

In order to maintain the temperature of the coldest part yielding in the light-transmissive airtight envelope 1 to relatively high desirable temperature, by holding sealing portions 1*b*, 1*b* of light-transmissive airtight envelope 1 to a required relatively low temperature, a thin hollow cylindrical portion communicating to the envelope 1*a* may be formed. In this case, it is common to form narrow clearance so-called capillary tube along each of thin hollow cylindrical portion by allocating sealing portions 1*b*, 1*b* on the ends of the thin hollow cylindrical portions while extending base ends of the electrodes 2, 2 into each of the thin hollow cylindrical portions. Here, the base ends of electrodes 2, 2 are connected to feed conductors, i.e., lead wires 4A, 4B.

A pair of electrodes 2, 2 is hermetically sealed to the light-transmissive airtight envelope 1, and they are allocated so that their head ends oppositely face the discharge space 1*c*. In the case of LCD projectors, the discharge gap between the pair of electrodes 2, 2 may be preferably 2 mm or less, while it may also be 0.5 mm. As for automobile headlights, the discharge gap is standardized in 4.2 mm. In the case of small-size lamp for general lighting, the above-mentioned discharge gap is set as 6 mm or less, while in the case of middle to large size lamps for general lighting, the discharge gap may be set as 6 mm or more.

As for constituent material of electrodes 2, 2, refractory and conductive metal, for example, pure Tungsten (W), doped tungsten containing one or more of dopants selected from a group of Scandium (Sc), Aluminum (Al), Potassium (K), Silicon (Si)), etc., treated tungsten containing thorium oxide, Rhenium (Re), or tungsten-rhenium (W—Re) alloy may be employed.

In the case of small size lamp, straight wire rod or wire rod with large-diameter head are employed for electrodes 2, 2. In the case of middle size to large size lamp, coil made of material homogenous to that of electrode might be wound on the tip ends of electrodes 2, 2 in the discharge space 1*c*. In the case that mercury-free high-pressure discharge lamp MHL operates with AC current, a pair of electrodes 2, 2 is formed in same configuration. However, in the case that mercury-free high-pressure discharge lamp MHL operates with DC current, anode electrode is made thick for extending heat dissipation surface, since in general the temperature of anode electrode becomes higher than the temperature of cathode electrode.

In the embodiment as shown in FIG. 1, over the tip ends through the middle portions to the base ends of the electrodes 2, 2 have uniform diameter shaft, and expose in the discharge space 1*c* by their tip ends and middle portions. The electrodes 2, 2 are allocated in prescribed positions in the light-transmissive airtight envelope 1 by that the base ends of the electrodes 2, 2 are welded to ends of metal foils 3, 3 on the side of envelope 1*a*, while the middle portions are loosely supported by sealing portions 1*b*, 1*b*.

Metal foils 3, 3 are made of Molybdenum that is optimum to them, as mentioned above.

A pair of lead wires 4A, 4B is derived outside through the ends of sealing portions 1*b*, 1*b*. As shown in FIG. 1, as for the lead wire 4A derived to opposite direction (rightward in the drawing) from the arc tube IT, its middle portion is folded along the outer bulb OT and then connected to ring-shaped one bulb base terminal t1 allocated on outer surface of the bulb base B. On the other hand, lead wire 4B derived toward the bulb base B (leftward in the drawing) from the arc tube IT is connected to pin-shaped other bulb base terminal (not shown), which is allocated in the center of the bulb base B along the outer bulb OT.

The ionization medium is characterized by that as described above, it contains the primary halide, the accessory halide and rare gas, but substantially excludes mercury therefrom.

Including at least thulium bromide constitutes the primary halide.

Including one or more metal halides selected from the prescribed group, as a primary constituent constitutes the accessory halide. The amounts of the above-mentioned thulium halide, i.e., the primary halide and the accessory halide, for example, zinc halide to the whole of the halide are specified as described below.

That is, in the first aspect of invention, when the mass percentage of thulium halide to whole halide is labeled A, and the mass percentage of the accessory halide is labeled B, the mass percentages A and B are specified to simultaneously satisfy relations 30<A<90 and 0<B<20.

Rare gas serves as starting gas and buffer gas, and one or more of Xenon (Xe), Argon (Ar), and Neon (Ne), etc. is utilized therefor. The charged pressure of rare gas can be suitably defined according to usage of mercury-free high-pressure discharge lamp.

Since Xenon with atomic weight higher than other rare gases has relatively low heat conductivity, Xenon contributes to lamp voltage establishment immediately after lighting by being filled by 0.6 atmosphere, or preferably by 5 atmosphere or more. Xenon is particularly suitable for the mercury-free high-pressure discharge lamp for usage of automobile headlights, since Xenon contributes to quicken luminous flux rising time by emitting white visible light at the starting time in low vapor pressure state of halide. Here, In the case of the mercury-free high-pressure discharge lamp for automobile headlights, suitable amount of Xenon is 6 atmosphere or more, and more suitably in the range of 8 to 16 atmosphere. By setting up the charged pressure of Xenon as mentioned above, Xenon is able to contribute for quickening luminous flux rising time and satisfies standard for white light-emitting of high intensity discharge lamp for automobile headlights.

Although it is preferable that mercury (Hg) is completely excluded for reducing environmental burdens, it is permitted that few amounts exist as impurities.

Outer bulb OT has an ultraviolet radiation blocking function, and accommodates therein arc tube IT. The small diameter portion 5 (only right-side one is shown in FIG. 1) of the outer bulb OT is glass-welded to the sealing portion 1*b* of the arc tube IT. Here, the inside of outer bulb OT communicates to ambient air.

Insulating inner tube T is made of ceramics, and covers the folded portion of lead wire 4.

Bulb base B is standardized for the usage of automobile headlights, and supports arc tube IT erected along the central axis of the bulb base B and outer bulb OT. The bulb base B is removably mounted on back of the automobile headlight. Further, the bulb base B is characterized by comprising followings, i.e., ring-shape bulb base terminal T1 allocated on cylindrical outer surface so as to be connected to power supply side lamp socket (not shown) at the time of mounting to the automobile headlight, and pin-shape bulb base terminal which projects in the axial direction of the lamp at the center in one end open concave.

PRACTICAL EXAMPLE I

The specification of the Practical Example I applied for metal halide lamp for use in the automobile headlights as shown in FIG. 1 is as follows.

<Light-transmissive airtight envelope 1>: Maximum outer diameter=6.0 mm; Solid sphere length=6.5 mm; Maximum inside diameter=2.4 mm <A pair of electrodes>: Made of doped tungsten; Shaft diameter=0.3 mm; Full length=10 mm; Discharge gap=4.2 mm <Ionization medium>: ZnI2(12.4)-TmI3(43.8)-TmBr(43.8)= 0.8 mg (notes: figure in a parenthesis is mass percentage), Xenon (Xe)=13 atmosphere <Electrical property>: lamp voltage=107V and lamp current=0.65 A and lamp electric power=60 W <Luminescent property>: total-luminous-flux=6,900 lm, luminosity=115 lm/W, and general-color-rendering-index Ra=91, color deviation=+0.0007

COMPARATIVE EXAMPLE 1

<Ionization medium>: ZnI2(12.5)-TmI3(72.6)-TlI(14.9)= 0.8 mg (notes: figures in parenthesis represent mass percentage), Xenon (Xe)=13 atmosphere <Electrical property>: lamp voltage=93V and lamp current=0.86 A and lamp electric power=60 W <Luminescent property>: total-luminous-flux=6,800 lm, luminosity=113 lm/W, and general-color-rendering-index Ra=93, color deviation=+0.0016

Other specifications are the same as those of Practical Example 1.

Figure 2:
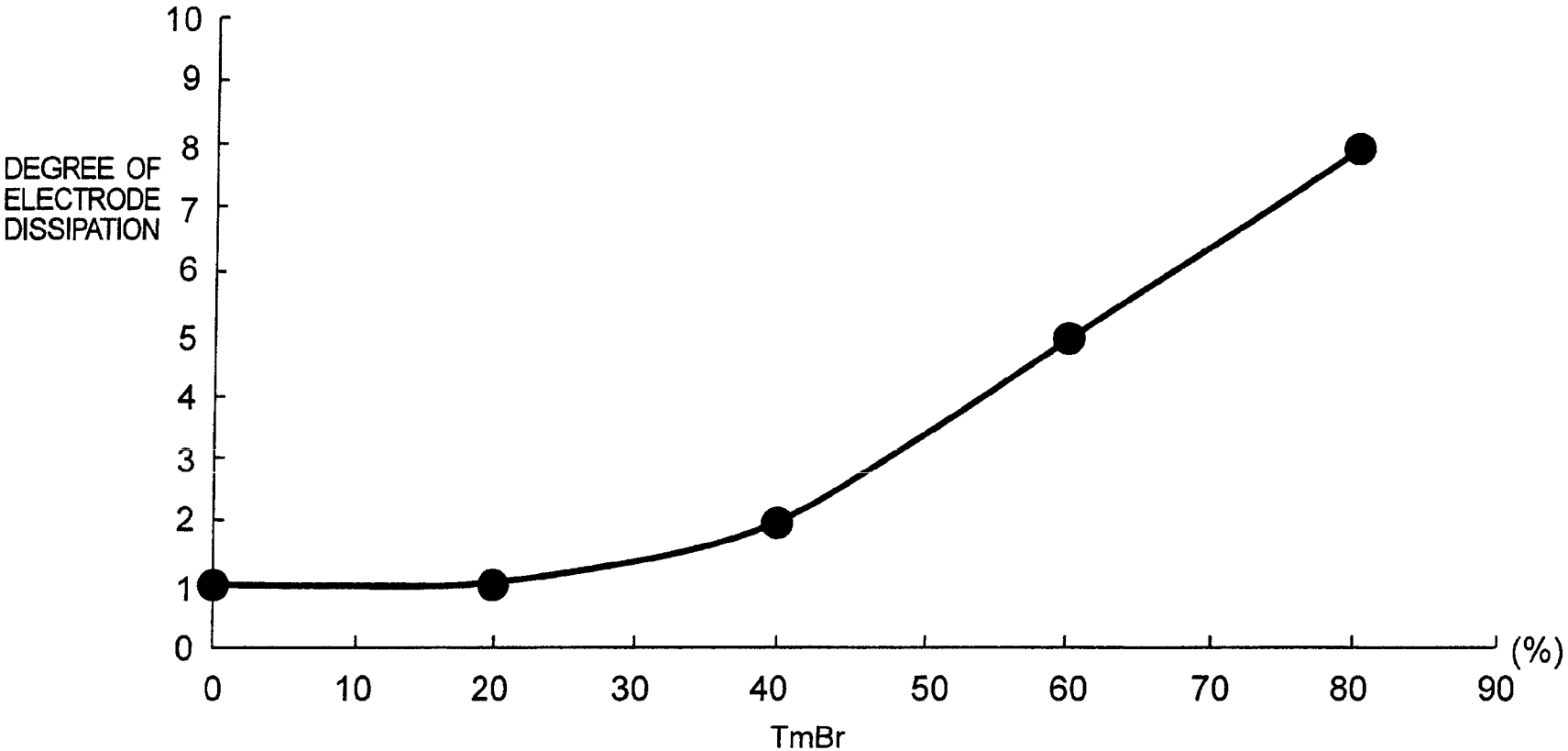
FIG. 2 is a graph showing a relation between mass percentage of thulium bromide to whole of halides and electrode dissipation in one embodiment of the mercury-free high-pressure discharge lamp according to the present invention.

FIG. 2 is a graph showing a relation between mass percentage of thulium bromide ($TmBr_3$) to whole of halides and electrode dissipation in the embodiment 1 of the mercury-free high-pressure discharge lamp according to the present invention. In FIG. 2, horizontal axis represents mass percentage of thulium bromide, while vertical axis represents degree of electrode dissipation (relative value).

As seen from FIG. 2, if the mass percentage of thulium bromide is less than 60, electrode dissipation or damage having serious influence on life hardly takes place. It is thought that it is because metal bromide reacts easily with Tungsten (W) that is the material of electrode in a specific temperature range, and then Tungsten (W) becomes eroded.

Now, a second aspect of invention will be explained.

In the aspect of invention, when the mass percentage of thulium halide to whole halide is labeled A, and the mass percentage of the accessory halide is labeled B, the mass percentages A and B are specified to simultaneously satisfy relations; 50<A+B<95 and 20<=B<90.

PRACTICAL EXAMPLE II

The specification of the Practical Example II applied for metal halide lamp for use in the automobile headlights as shown in FIG. 1 is as follows.

<Light-transmissive airtight envelope 1>: maximum outer diameter=10 mm, solid sphere length=10 mm, maximum inside diameter=6 mm, <A pair of electrode>: the product made from doped tungsten, shaft diameter=0.4 mm, full length=10 mm, discharge gap=1.2 mm <Ionization medium>: ZnI2(50.0)-TmI3(20.0)-TmBr3 (30.0)= 4 mg (notes: figure in a parenthesis is mass percentage), Xenon (Xe)=13 atmosphere <Electrical property>: lamp voltage 54V and lamp electric power=100 W <Luminescent property>: total luminous flux=6,500 lm; luminosity=65 lm/W

COMPARATIVE EXAMPLE 2

<Ionization medium>: ZnI2 (50.0)-Tl3 (12.5)-TmI3 (37.5) 4 mg (notes: figure in a parenthesis is mass percentage), Xenon (Xe)=13 atmosphere <Electrical property>: lamp voltage=48V; lamp electric power=100 W <Luminescent property>: total luminous flux=6,000 lm; luminosity=60 lm/W Other specifications are the same as those of Practical Example II.

As seen from comparing Practical Example II and Comparative Example 2, high lamp voltage can be achieved by the second aspect of invention.

PRACTICAL EXAMPLE III

The specification of the Practical Example III applied for metal halide lamp for use in the luminare.

<Light-transmissive airtight envelope>: maximum outer diameter=10 mm, solid sphere length=15 mm, maximum inside diameter=9 mm <A pair of electrode>: the product made from doped tungsten, shaft diameter=0.5 mm, discharge gap=9 mm <Ionization medium>: $ZnI_2$=1 mg (as pellet), $TmI_3$(37.5)-$TmBr_3$(37.5)-NaI(25)=5 mg (as pellet, notes: figure in a parenthesis is mass %), Xenon (Xe)=13 atmosphere <Electrical property>: lamp voltage 96V and lamp electric power=100 W <Luminescent property>: luminous efficiency=90 lm/W FIG. 3 is a block diagram showing one aspect of the mercury-free high-pressure discharge lamp lighting device for lighting the mercury-free high-pressure discharge lamp according to the present invention. The lighting circuit according to this aspect of invention employs low frequency AC lighting system. As shown in FIG. 3, the lighting circuit is comprised of direct-current power source DC, voltage boosting chopper BUT, full bridge type inverter FBI, and igniter IG. Here, MHL represents the afore-mentioned mercury-free high-pressure discharge lamp according to the present invention.

DC power source DC is, for example, a battery equipped on automobile.

The voltage boosting chopper BUT is connected its input terminal to the direct-current power source DC.

The full-bridge inverter FBI is connected its input terminal to the output terminal of the voltage boosting chopper BUT.

Igniter IG generates high-voltage starting pulse by being input with low-frequency AC electricity. At the time of starting operation, the high-voltage starting pulse is applied over a pair of electrodes of metal halide lamp MHL as described later.

High-pressure discharge lamp MHL, has the composition as shown in FIG. 1. The high-pressure discharge lamp MHL is connected to the output terminals of the full bridge type inverter FBI, and operates in low frequency AC lighting.

Figure 4:
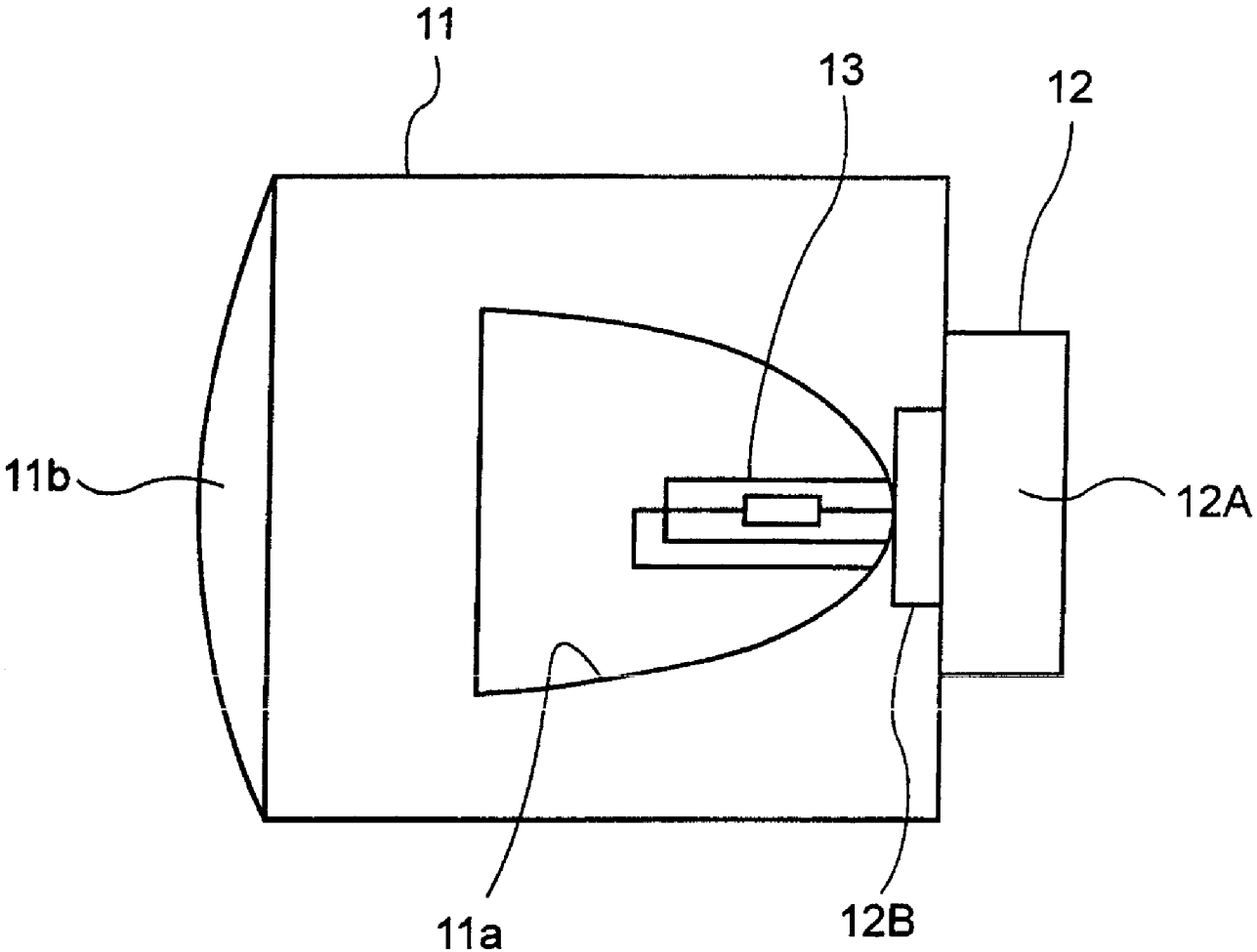
FIG. 4 is a schematic side view showing an automobile headlight embodying the luminaire according to the present invention.

FIG. 4 is a schematic side view showing mercury-free high-pressure discharge lamp lighting system for use of the automobile headlight as another aspect of the present invention. As shown in FIG. 4, the mercury-free high-pressure discharge lamp lighting system is comprised of headlight main body 11 and metal halide lamp 13.

The headlight main body 11 is formed in cup-shape, and provided with a reflection mirror 11*a* inside thereof, a lens 11*b* on its front and a lamp socket (not shown).

Figure 3:
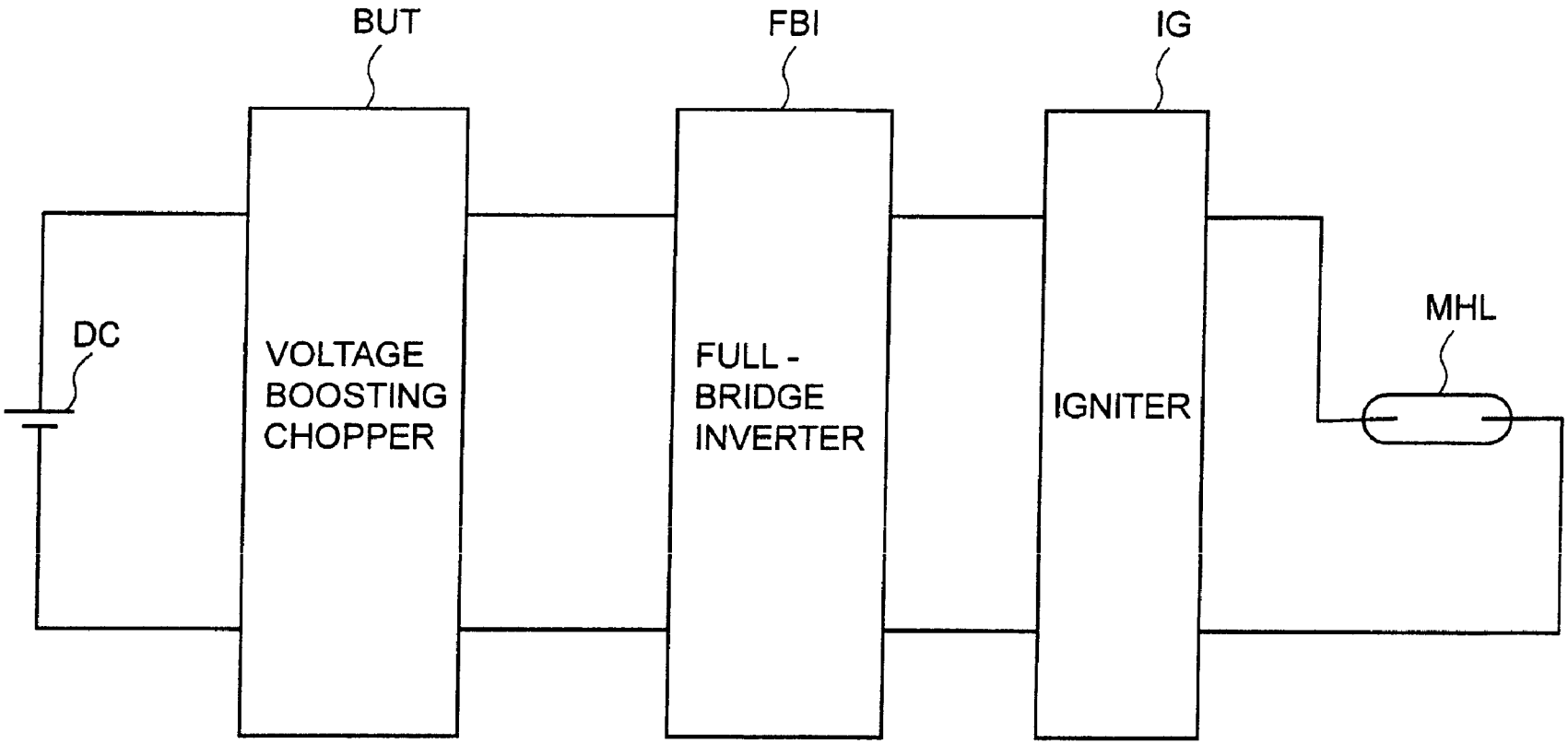
FIG. 3 is a block diagram showing an exemplary mercury-free high-pressure discharge lamp lighting system for lighting the mercury-free high-pressure discharge lamp according to the present invention.

The mercury-free high-pressure discharge lamp lighting device 12 is provided with lighting circuit as shown in FIG. 3, and has main lighting circuit 12A and starter 12B. The main lighting circuit 12A is constituted by voltage boosting chopper BUT and full-bridge inverter FBI as principal components. Similarly starter 12B is constituted by igniter IG as principal component.

The mercury-free high-pressure discharge lamp 13 for usage of automobile headlights is mounted to the lamp socket and then it is lit up.

According to the present invention, since the primary halide includes thulium halide and then the thulium halide includes at least thulium bromide, while since the accessory halide includes one or more metal halides selected from the prescribed group as a primary constituent, thulium halide is possible to be easily pelletized. As a result, mercury-free high-pressure discharge lamp can be easily manufactured. In addition, the present invention is able to provide mercury-free high-pressure discharge lamp excellent in life property, luminosity and electrical property and luminaire using this mercury-free high-pressure discharge lamp.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. A mercury-free high-pressure discharge lamp comprising:

a light-transmissive airtight envelope enclosing therein a discharge space;

a pair of electrodes sealed inside the light-transmissive airtight envelope and facing the discharge space; and an ionization medium filled in the light-transmissive airtight envelope, which includes primary halide, accessory halide and rare gas while substantially excluding mercury therefrom, wherein the primary halide includes at least thulium bromide having an innumerable emission spectrum primarily around the peak of a luminosity efficiency curve;

the accessory halide includes one or more metal halides including a halide of Magnesium (Mg), Iron (Fe), Cobalt (Co), Chromium (Cr), Zinc (Zn), Nickel (Ni), Manganese (Mn), Aluminum (Al), Antimony (Sb), Bismuth (Bi), Beryllium (Be), Rhenium (Re), Gallium (Ga), Titanium (Ti), Zirconium (Zr) or Hafnium (Hf) or any combination thereof which primarily contributes to fix lamp voltage; the amounts of thulium halide and the accessory halide in the ionization medium satisfy following relations, $$30<A<90$$

$$0<B<20$$

where "A" represents the mass percentage of the thulium halide to the whole of halides and "B" represents the mass percentage of the accessory halide to the whole of halides.

2. A mercury-free high-pressure discharge lamp as claimed in claim 1, wherein, the amount of thulium bromide in the ionization medium satisfies a following relation, when the mass percentage of the thulium bromide to the whole of halides is labeled "C", $$5<C<60.$$

3. A luminaire, comprising:

a luminaire main-body; and the mercury-free high-pressure discharge lamp as claimed in claim 1, which is mounted on the luminaire main-body; and a lighting circuit for lighting the mercury-free high-pressure discharge lamp.

* * * * *